US009074500B2

(12) United States Patent
Jung et al.

(10) Patent No.: US 9,074,500 B2
(45) Date of Patent: Jul. 7, 2015

(54) ENGINE OIL PUMP INCLUDING PLUNGE POOL TO MITIGATE SURGE NOISE

(75) Inventors: Byunghwan Jung, Gwangmyeong-si (KR); Wonjo Jeong, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 231 days.

(21) Appl. No.: 13/285,406

(22) Filed: Oct. 31, 2011

(65) Prior Publication Data

US 2012/0315177 A1 Dec. 13, 2012

(30) Foreign Application Priority Data

Jun. 9, 2011 (KR) ..... 10-2011-0055627

(51) Int. Cl.

| | |
|---|---|
| ***F01M 1/02*** | (2006.01) |
| ***F04C 29/06*** | (2006.01) |
| ***F04C 2/08*** | (2006.01) |
| ***F04C 2/10*** | (2006.01) |
| ***F04C 15/06*** | (2006.01) |

(52) U.S. Cl.

CPC ..... *F01M 1/02* (2013.01); *F04C 29/065* (2013.01); *F04C 29/068* (2013.01); *F04C 2/086* (2013.01); *F04C 2/102* (2013.01); *F04C 15/06* (2013.01); *F04C 2250/102* (2013.01)

(58) Field of Classification Search

CPC ..... F01M 1/02; F04C 15/06; F04C 2250/102; F04C 29/065; F04C 29/068; F04C 2/086; F04C 2/102

USPC ..... 418/156, 61.3, 157, 160, 161, 164, 166, 418/171, 61.2

See application file for complete search history.

(56) References Cited

U.S. PATENT DOCUMENTS

| | | | | |
|---|---|---|---|---|
| 1,986,003 | A * | 1/1935 | Lum | 137/209 |
| 5,263,512 | A * | 11/1993 | Emori et al. | 137/625.23 |
| 2005/0106053 | A1 * | 5/2005 | Ohnishi et al. | 418/61.2 |

FOREIGN PATENT DOCUMENTS

| | | | |
|---|---|---|---|
| JP | 9-25809 | A | 1/1997 |
| JP | 9-105318 | A | 4/1997 |
| JP | 9264494 | A | 10/1997 |
| JP | 10-77817 | A | 3/1998 |
| JP | 2004-285999 | A | 10/2004 |
| JP | 2010275974 (A) | | 12/2010 |
| KR | 1020040093559 (A) | | 11/2004 |
| KR | 100492857 (B1) | | 5/2005 |
| KR | 1020070021675 (A) | | 2/2007 |

OTHER PUBLICATIONS

Dictionary definition of 'streamlined' [online], Dictionary.com [retreived on Feb. 15, 2014]. Retreived from the Internet: <URL: dictionary.reference.com/browse/streamlined>.*

* cited by examiner

*Primary Examiner* — Mary A Davis
*Assistant Examiner* — Paul Thiede
(74) *Attorney, Agent, or Firm* — Morgan, Lewis & Bockius LLP

(57) ABSTRACT

An engine oil pump, may include a plunge pool formed in a pump case and preventing a rapid change in pressure of oil when the oil may be discharged through an oil discharge portion that may be a cross-section expansion section by generating vortex flux when oil, which may be pumped into an oil pocket by rotation of an inner rotor and an outer rotor, temporarily collects before being discharged after passing a cross-sectional reduction section, and reducing the pressure by consuming the energy of the oil increasing in pressure by the vortex flux.

5 Claims, 6 Drawing Sheets

ENGINE OIL PUMP INCLUDING PLUNGE POOL TO MITIGATE SURGE NOISE

CROSS-REFERENCE TO RELATED APPLICATIONS

The present application claims priority to Korean Patent Application Number 10-2011-0055627 filed Jun. 9, 2011, the entire contents of which application is incorporated herein for all purposes by this reference.

BACKGROUND OF THE INVENTION

1. Field of the Invention

The present invention relates to an engine oil pump, and more particularly, to an engine oil pump that does not make a rapid change in pressure, which may cause surging noise when oil is discharged, by inducing energy consumption of high-pressure oil.

2. Description of Related Art

In general, engine oil pumps supply oil to an engine.

FIG. 4A shows an inner rotor 100 and an outer rotor 200 that are disposed and rotated in a pump case 400, and as shown in the figure, inner rotor 100 and outer rotor 200 form an oil pocket 300, which is a space where oil is filled, when rotating.

Therefore, the pumped oil is discharged out of a discharge portion through oil pocket 300 and supplied to the parts of the engine.

FIG. 4B shows a cross-sectional structure of oil pocket 300, and as shown in the figure, oil pocket 300 is formed on the path through which the oil flows into an oil intake portion 600 and then is discharged to an oil discharge portion 700, separates oil intake portion 600 and oil discharge portion 700, and forms a sealing-forming surface 500 where rotors 100 and 200 come in close contact.

Therefore, the size of oil pocket 300 gradually increases toward sealing-forming surface 500 from oil intake portion 600 in the rotation direction of rotors 100 and 200, and becomes the maximum at sealing-forming surface 500.

Thereafter, oil pocket 300 gradually decreases in size through sealing-forming surface 500 and discharges the oil to the discharge portion.

However, in oil pocket 300, the cross-section is suddenly reduced by sealing-forming surface 500 formed between oil intake portion 600 and oil discharge portion 700, such that when the oil flows from oil intake portion 600 to oil discharge portion 700, pressure is rapidly increased at sealing-forming surface 500, and accordingly, the pressure of the oil in oil pocket 300 is increased.

On the contrary, when the oil flows from sealing-forming surface 500 to oil discharge portion 700, the cross-section suddenly increases at oil discharge portion 700, such that the pressure of the oil is decreased.

As described above, when the change in pressure is large while the oil flows from oil intake portion 600 to oil discharge portion 700 through sealing-forming surface 500, surging noise due to the change in pressure is necessarily generated.

FIG. 4B shows the cross-sectional structure for reducing a change in pressure that causes surging noise, and as shown in the figure, a rapid change in pressure of the oil is prevented by forming a discharge incline at the interface continuing from sealing-forming surface 500 to oil discharge portion 700, such that the magnitude of surging noise is largely reduced.

However, when the discharge incline is used, as described above, the object for preventing a rapid change in pressure can be effectively achieved only when the length of the inclined surface of the discharge incline is sufficiently large, and in order for the effect, it is troublesome to make the length of the inclined surface of the discharge incline different in accordance with the specification of the oil pump, and particularly, an optimum design is necessarily made when the performance of the oil pump is changed, such that continuous optimization is necessary.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine oil pump that can considerably decrease the oil pressure in an oil pocket by consuming the energy of the oil of which the pressure is increased by reduction of a cross-section due to a sealing surface of the oil pocket making a temporary oil-filled space when the oil is pumped, through vortex and can considerably decrease surging noise by largely decreasing the degree of change in pressure of the oil passing through a cross-section increasing section connected from the oil pocket to the decreased oil pressure in the oil pocket.

In an aspect of the present invention, the engine oil pump may include a plunge pool formed in a pump case and preventing a rapid change in pressure of oil when the oil may be discharged through an oil discharge portion that may be a cross-section expansion section by generating vortex flux when oil, which may be pumped into an oil pocket by rotation of an inner rotor and an outer rotor, temporarily collects before being discharged after passing a cross-sectional reduction section, and reducing the pressure by consuming the energy of the oil increasing in pressure by the vortex flux.

The plunge pool may be formed at the oil pocket.

The plunge pool may have a pool space that may be a space formed in the pump case wherein the oil generates vortex flow, and a bank that forms the pool space in a predetermined shape at a side and induces oil flow into the vortex flow thereby.

The bank may be formed to protrude from a base with a predetermined length in a radial direction thereof.

A wall of the bank may be formed in a substantially triangular shape, and the wall may include a pool forming surface that faces the pool space at the side and may be shaped to generate the vortex flux in the oil, and a bank forming surface that faces the oil discharge portion at the opposite side of the pool space.

The pool forming surface may be shaped of a streamline that may be convex downward from the base of the bank to the top thereof.

The bank may have a bank height B that forms the plunge pool and does not fully block the oil discharge portion through which the oil overflowing the oil pocket may be discharged.

The size of the pool space may be varied according to a bank position gap A at which the bank may be measured between the pull-forming surface and an inner surface of the pool space.

The bank height B may be less than or equal to approximately 80% of a channel height H of the oil discharge portion.

The pool space may have the same height as that of the sealing-forming surface that may be a rapid cross-section reduction section where the oil passes to collect in the oil pocket after passing an oil intake portion.

A bottom of the pool space may be recessed downward from the base.

According to the exemplary embodiments of the present invention, it is possible to prevent a rapid change in oil pressure when the oil is discharged through the cross-section increasing section by promoting energy consumption of the oil by the vortex in the oil pocket making the temporary oil-filled space when the oil is pumped.

Further, according to the exemplary embodiments of the present invention, it is possible to largely decrease surging noise because a rapid change in pressure is not caused even behind the cross-section increasing section, because the oil pressure is reduced by the vortex generated in the oil pocket.

In addition, according to the exemplary embodiments of the present invention, since the oil pressure is not influenced by the discharge incline of the cross-section increasing section by decreasing the oil pressure in the oil pocket making the temporary oil-filled space when the oil is pumped, there is no need to perform the optimization of the length of the inclined surface of the discharge incline according to the specifications of the oil pump, which is required when the discharge incline is used.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1A:
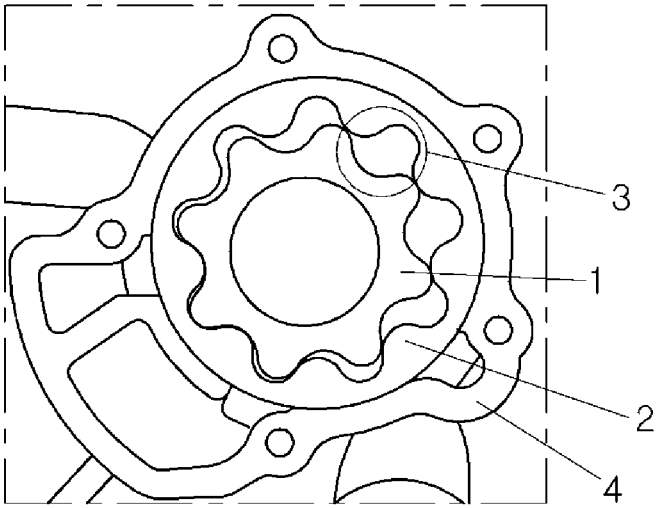
FIGS. 1A and 1B are views showing the internal configuration of an engine oil pump according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention are described hereafter in detail with reference to the accompanying drawings, and the exemplary embodiments can be achieved in various ways by those skilled in the art and the present invention is not limited to the exemplary embodiments.

FIG. 1A shows the internal configuration of an engine oil pump according to an exemplary embodiment of the present invention.

As shown in the figure, an inner rotor 1 and an outer rotor 2, which pump oil by rotating, are disposed in a pump case 4 of an engine oil pump, and an oil pocket 3 that is a space temporarily filled with the oil pumped and discharged when the rotors rotate is formed at inner rotor 1 and outer rotor 2.

Figure 1B:
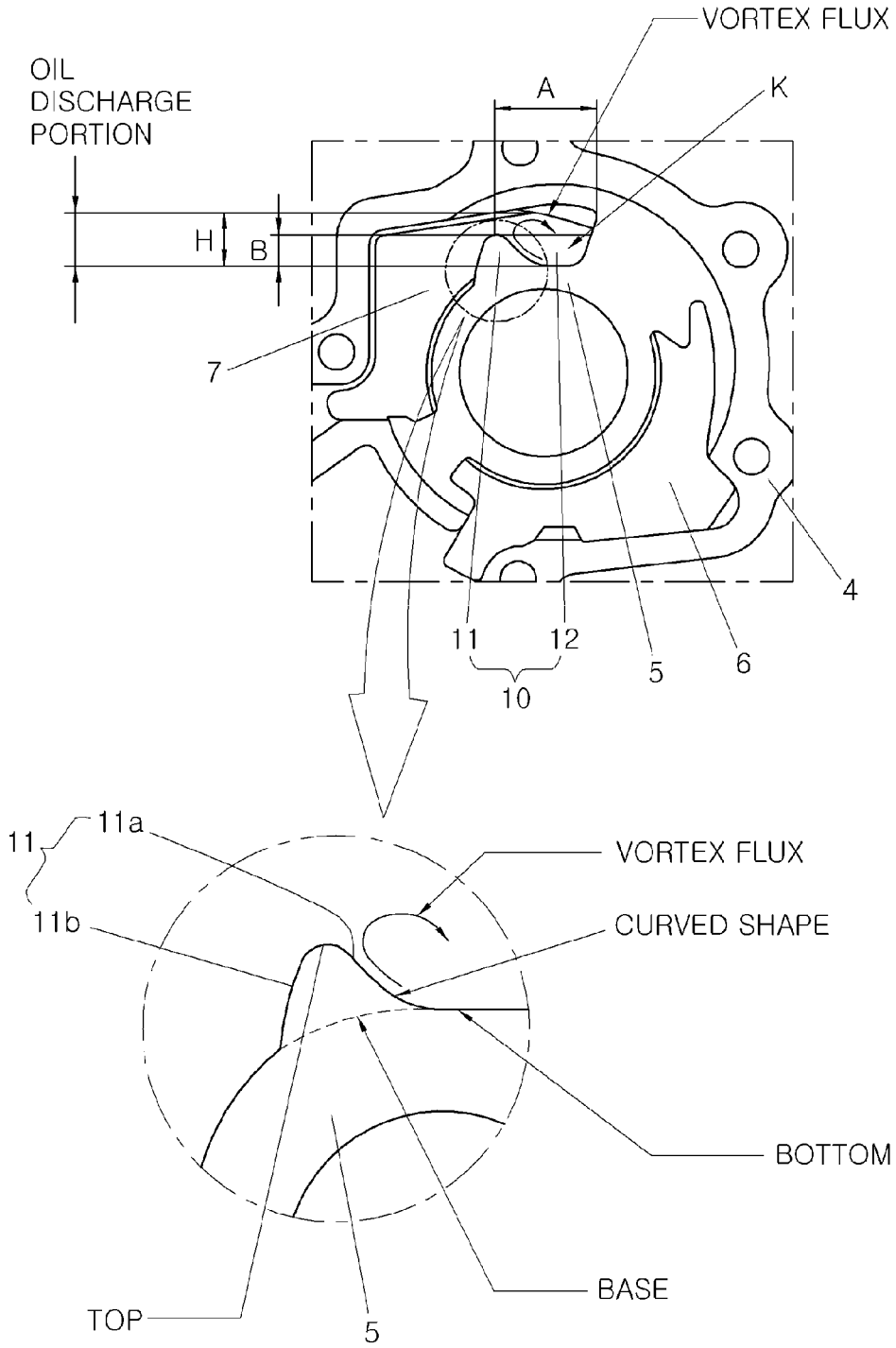

FIG. 1B shows the internal structure of pump case 4 according to an exemplary embodiment of the present invention, a sealing-forming surface 5, which separates pump case 4 into an oil intake portion 6 where the oil is pumped and flows is formed at a side of pump case 4 and a sealing-forming surface 5 through where the pumped oil is discharged through oil pocket 3 at the other side, is formed in pump case 4.

A plunge pool 10 constituting oil pocket 3 is formed at oil discharge portion 7 in pump case 4 divided by sealing-forming surface 5.

Plunge pool 10 promotes energy consumption such that the energy of the oil does not cause an increase in pressure by making vortex in the oil collecting in oil pocket 3.

For this configuration, plunge pool 10 includes a pool space 12 having various shapes and a bank 11 that generates vortex flux while collecting the oil into pool space 12 by occupying the space of oil discharge portion 7 of pump case 4 divided by sealing-forming surface 5.

Bank 11 protrudes from a base 20 without fully blocking the space of oil discharge portion 7 and is implemented in a substantially triangular shape by using a pull-forming surface 11*a* facing pull space 12 and a bank-forming surface 11*b* facing oil discharge portion 7 at the opposite side.

Since bank 11 specifies plunge pool 10, in the exemplary embodiment, an optimum design of plunge pool 10 is implemented by using a bank position gap A and a bank height B of bank 11.

For example, when the bank position gap A of bank 11 is the distance (one-tooth distance) of one tooth of inner rotor 1 or more, and bank height B is set about at 80% or less of a channel height H of oil discharge portion 7 in order not to block oil discharge portion 7.

The reason why bank height B is limited to 80% of channel height H is because if it is over the ratio, resistance is generated in the oil that overflows and the pressure of plunge pool 10 is necessarily increased, such that it acts as one of various causes generating surging and surging is generated.

In the structure, pool forming surface 11*a* of bank 11 facing pool space 12 has a shape smoothly connected throughout the entire section of bank height B on the oil surface set by bank height B.

In the exemplary embodiment, pool forming surface 11*a* has a streamline shape that is convex downward from the base 20 of bank 11 to the top, such that it can make the oil flow toward the inside of pool space 12 and can induce generation of vortex.

Pool space 12 is integrally formed at the same height of sealing-forming surface 5 such that the collecting oil smoothly overflows to oil discharge portion 7.

Further, in an exemplary embodiment of the present invention, the bottom of pool space 12 may be recessed from the base 20 such that a larger amount of oil remains in the pool space 12.

Meanwhile, pool space 12 has various shapes to increase energy consumption ratio of the oil and FIGS. 2A to 2E show various modified examples of pool space 12.

Figure 2A:
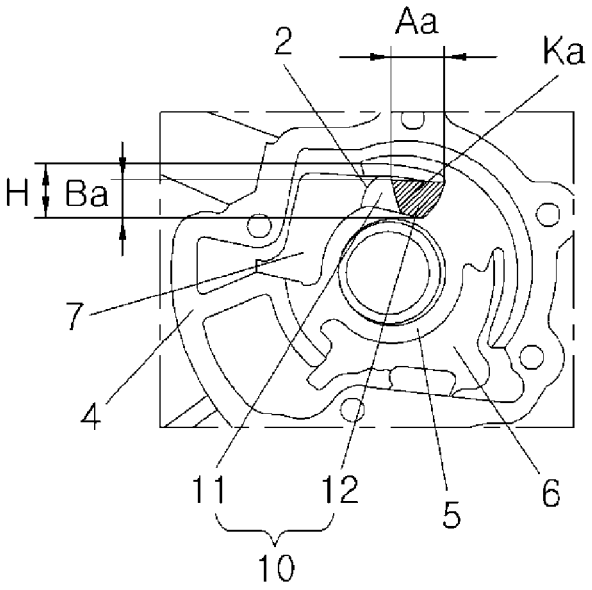
FIGS. 2A to 2E show modified examples of a plunge pool formed at the engine oil pump according to an exemplary embodiment of the present invention.

Bank height B of pool space 12 shown in FIG. 2A maximally fit to 80% that is the limit condition to channel height H such that the depth retaining the oil can be the largest while a pool shape Ka formed when bank position gap Aa is made closer to the opposite wall of bank 11 is implemented.

Figure 2B:
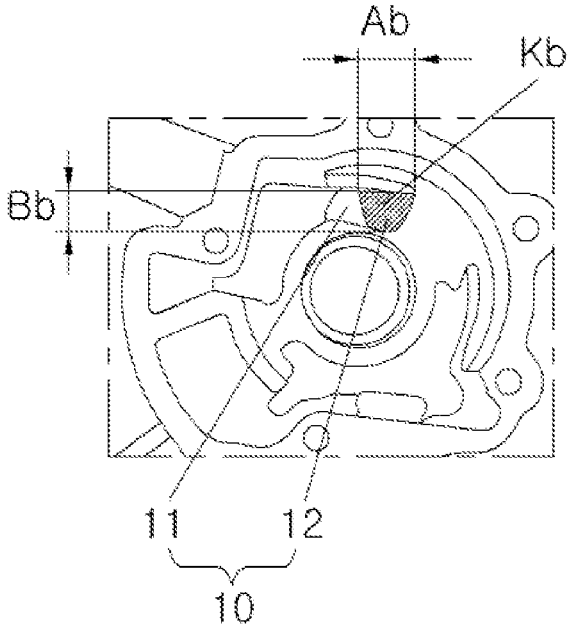

Bank height Bb of pool space 12 shown in FIG. 2B is set similar to pool space 12 shown in FIG. 2A, but a pool shape Kb is formed when a bank position gap Ab is made relatively closer to the opposite wall of bank 11 is implemented.

Figure 2C:
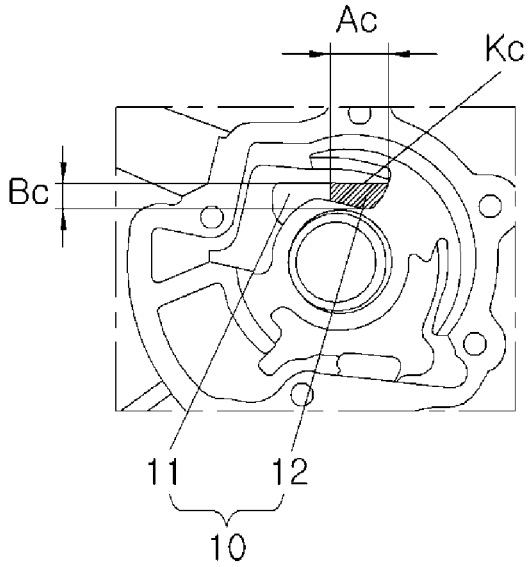

Bank height Bc of pool space 12 shown in FIG. 2C is considerably decreased than 80% that is the limit condition to channel height H, such that the depth retaining the oil is more reduced while a pool shape Kc formed when bank position gap Ac is made further from the opposite wall of bank 11 is implemented.

Figure 2D:
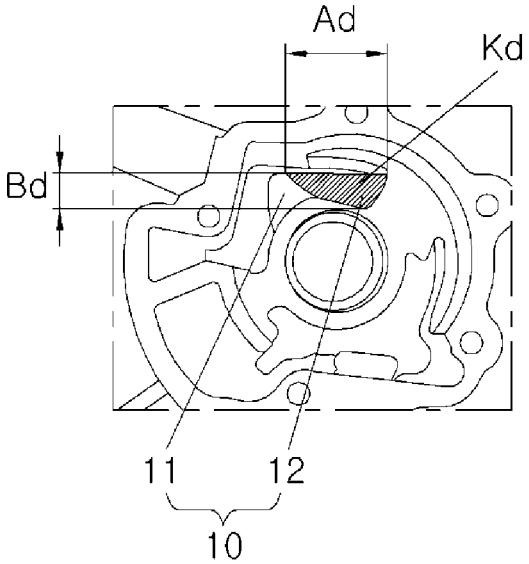

Bank height Bd of pool space 12 shown in FIG. 2D is set similar to pool space 12 shown in FIG. 2C, but a pool shape Kd is formed when a bank position gap Ad is made further from the opposite wall of bank 11 is implemented.

Figure 2E:
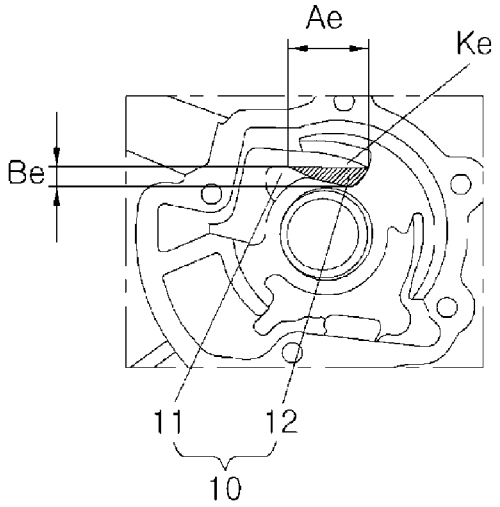

Bank height Be of pool space 12 shown in FIG. 2E is set similar to pool space 12 shown in FIG. 2C, but a pool shape Ke formed when a bank position gap Ae is made furthest from the opposite wall of bank 11 is implemented.

As described above, in the exemplary embodiment, it is possible to adjust the degree of smooth overflowing to oil discharge portion 7 after the oil collecting in pool space 12 when the oil is discharged, such that it is possible to more increase efficiency of reduction of surging noise, by variously changing pool shapes Ka, Kb, Kc, Kd, and Ke of pool space 12.

When the engine oil pump is driven, as in the related art described above, the pumped oil temporarily collects in oil pocket 3 by the rotation of inner rotor 1 and outer rotor 2 through sealing-forming surface 5 from oil intake portion 6, and then naturally overflows to oil forming portion 7 and is discharged to oil discharge portion 7, such that the oil can be supplied to the parts of the engine.

In the process described above, the oil passing oil intake portion 6 flows into sealing-forming surface 5 that is the rapid cross-section reduction portion, such that the pressure is necessarily increased.

As described above, when the oil at the high pressure overflows to oil discharge portion that is the rapid cross-section reduction portion, surging noise is necessarily caused by a large change in pressure.

However, in the exemplary embodiment, vortex flux is generated in the oil at high pressure by the operation of plunge pool 10, such that a large change in pressure that causes surging noise is not generated.

That is, the oil generates the vortex flux due to plunge pool 10 and more energy is consumed and it is converted into a low energy level state, such that the pressure can be reduced again when the oil collects in oil pocket 3 even if the pressure is increased when the oil passes sealing-forming surface 5 that is the rapid cross-section reduction portion.

Therefore, even if the engine oil pump necessarily has a rapid cross-section reduction and cross-section expansion structure due to the structural characteristics of the oil discharge path, it is possible to largely reduce the pressure of the oil collected in oil pocket 3 and this does not require a design for optimizing the discharge incline of the inclined surface connecting the interface of sealing-forming surface 5 and oil discharge portion 7 in accordance with the pump specifications, as in the related art.

Figure 3:
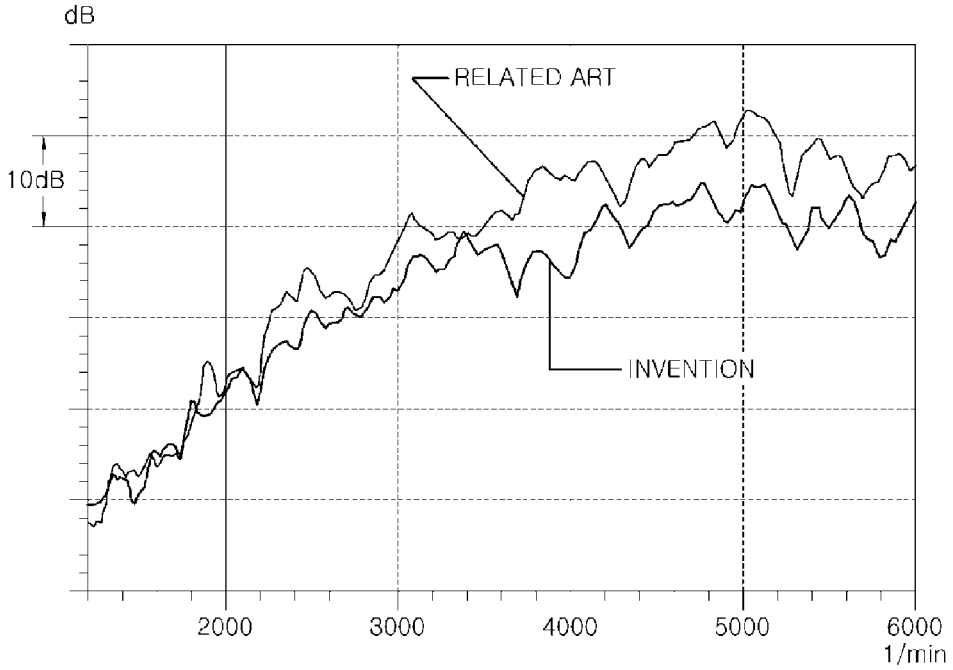
FIG. 3 is a noise graph of the engine oil pump according to an exemplary embodiment of the present invention.
Figure 4A:
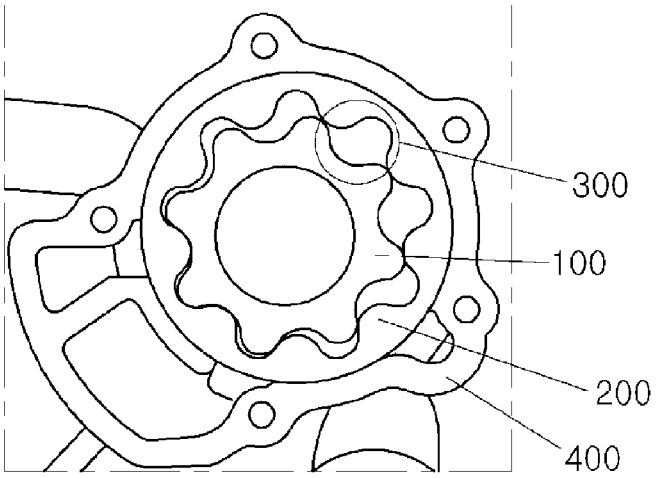
FIG.4A (Prior Art)
FIGS. 4A and 4B are views showing the internal configuration of an engine oil pump according to the related art.
Figure 4B:
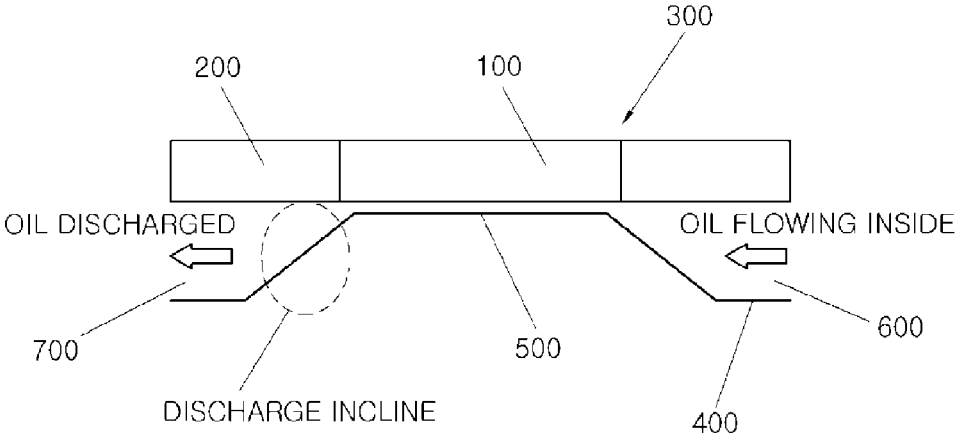
FIG.4B (Prior Art)

FIG. 3 is a noise graph according to an actual test of an engine oil pump.

As in the related art, when surging noise is reduced by using the discharge incline of the inclined surface connecting the interface of sealing-forming surface 5 and oil discharge portion 7 and the noise performance of the engine oil pump is the reference, as shown in the figure, it is possible to reduce the surging noise by about 10 dB or more by using plunge pool 10.

As described above, in the engine oil pump according to the exemplary embodiment of the present invention, plunge pool 10 having bank 11 generating vortex flux in a downward-convex streamline shape is formed in oil pocket 3 that is the oil-filled spaces formed by the rotation of inner rotor 1 and outer rotor 2.

It is possible to largely reduce surging noise even not using a discharge incline W optimized for the oil discharge path because it is possible to maintain the pressure of the oil collecting in oil pocket 3 at a low level, by consuming the energy of the oil that is increased in pressure while passing sealing-forming surface 5 that is the rapid cross-section portion after flowing into oil intake portion 6 by using vortex flux of the oil generated in plunge pool 10.

For convenience in explanation and accurate definition in the appended claims, the terms "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine oil pump, comprising:

an inner rotor and an outer rotor disposed in a pump case configured to pump oil by rotation;

an oil pocket that is a space formed between the inner rotor and the outer rotor configured for being temporarily filled with the pumped oil and discharging the pumped oil when the inner and outer rotors rotate;

a sealing-forming surface formed in the pump case and configured to separate a space within the pump case into an oil intake portion and an oil discharge portion, wherein the pumped oil flows from the oil intake portion to the oil discharge portion through the sealing-forming surface within the pump case and the pumped oil is discharged through the oil discharge portion and the oil pocket; and a plunge pool formed in the oil discharge portion and including a bank and a pool space, wherein the bank is formed protrusively in the oil discharge portion and is configured to partially block an oil flow such that the pumped oil is temporarily held stagnant by the bank and wherein the pool space is recessed from the bank between the bank and the sealing-forming surface, wherein the bank has a pool-forming surface facing the pool space and the pool forming surface has a curved shape to generate vortex flux of the oil flow in the pool space when the oil flow collides with the pool-forming surface of the bank, wherein a bank height (B) of the bank is less than a channel height (H) of the oil discharge portion such that the oil overflowing the oil pocket is discharged through a gap between the bank and an inner surface of the oil discharge portion, wherein the bank protrudes from a portion of the sealing forming surface into the oil flow such that a cross section of the bank is substantially a triangle in shape, and wherein the pool forming surface facing the pool space forms one side of the triangle.

2. The engine oil pump as defined in claim 1, wherein the oil pocket is formed on an oil flow path from the oil intake portion to the oil discharge portion.

3. The engine oil pump as defined in claim 1, wherein the curved shape of the pool forming surface is convex downward from a bottom of the bank to a top thereof.

4. The engine oil pump as defined in claim 1, wherein the bank height (B) is less than or equal to approximately 80% of a channel height (H) of the oil discharge portion.

5. The engine oil pump as defined in claim 1, wherein a shape of the pool space is concave.

* * * * *